US005327591A

United States Patent [19]

Fireman et al.

[11] Patent Number: 5,327,591

[45] Date of Patent: Jul. 12, 1994

[54] THREE FRAME CONVERTIBLE FUTON SOFA BED

[75] Inventors: Robert Fireman, 785 W. End Ave., New York, N.Y. 10025; Ralph Rosenow, Corinth, Miss.

[73] Assignee: Robert Fireman, New York, N.Y.

[21] Appl. No.: 47,998

[22] Filed: Apr. 19, 1993

[51] Int. Cl.[5] ..... A47C 17/17

[52] U.S. Cl. ..... 5/47; 5/38; 5/42.1; 5/55.1

[58] Field of Search ..... 5/37.1, 38, 41, 42.1, 5/47, 48, 55.1

[56] References Cited

U.S. PATENT DOCUMENTS

| | | | |
|---|---|---|---|
| 268,941 | 12/1882 | Sands . | |
| 302,919 | 8/1884 | Lockhart . | |
| 715,114 | 12/1902 | Mooers . | |
| 910,952 | 1/1909 | Phillipson | 5/42.1 |
| 927,811 | 7/1909 | Phillipson . | |
| 941,186 | 11/1909 | Brown . | |
| 1,061,496 | 5/1913 | Potts . | |
| 1,982,930 | 12/1934 | Russo | 5/37 |
| 2,034,985 | 3/1936 | Lilley | 155/49 |
| 2,244,470 | 6/1941 | Neunherz | 5/38 |
| 2,278,458 | 4/1942 | Martin | 5/47 |
| 2,769,987 | 11/1956 | Thal | 5/37 |
| 3,002,198 | 10/1961 | Kaiser, Jr. | 5/41 |
| 3,634,893 | 1/1972 | Hern et al. | 5/37 |
| 4,365,369 | 12/1982 | Plume | 5/38 |
| 4,480,344 | 11/1984 | Padovan | 5/48 |
| 4,538,308 | 9/1985 | Grigoriev | 5/37 |
| 4,642,823 | 2/1987 | Wiggins | 5/47 |
| 4,651,363 | 3/1987 | Mizelle | 5/37 |
| 4,696,069 | 9/1987 | Crosthwaite | 5/37 |
| 4,800,598 | 6/1989 | Arft | 5/13 |
| 4,829,611 | 5/1989 | Fireman et al. | 5/47 |
| 4,875,244 | 10/1989 | Tremblay | 5/37 |
| 4,939,802 | 7/1990 | Lafer | 5/37 |
| 5,146,640 | 9/1992 | Barton et al. | 5/47 |
| 5,153,952 | 10/1992 | Barton et al. | 5/47 |
| 5,170,519 | 12/1992 | Meade | 5/37.1 |
| 5,201,083 | 4/1993 | Johnson | 5/38 |

*Primary Examiner*—Michael F. Trettel
*Attorney, Agent, or Firm*—Auslander & Thomas

[57] ABSTRACT

A three piece sofa bed recliner has an end frame, seat frame and back frame. The frame ends are linked overlapped. Interengaging the seat frame with the back frame enables a simple conversion process from sofa bed to recliner. The back frame and end frames fold toward each other as the interlocked seat frame is moved backward. The end frame and back frame interlock with the end frame leg and the seat frame and back frame interlock releases during conversion. Reconversion is a simple forward pull unfolding the respective frames on their legs with an extending pivoted leg set between the end frame and back frame. Wheels facilitate movements. The end frame may be used to be a chaise lounge.

21 Claims, 4 Drawing Sheets

FIG.6
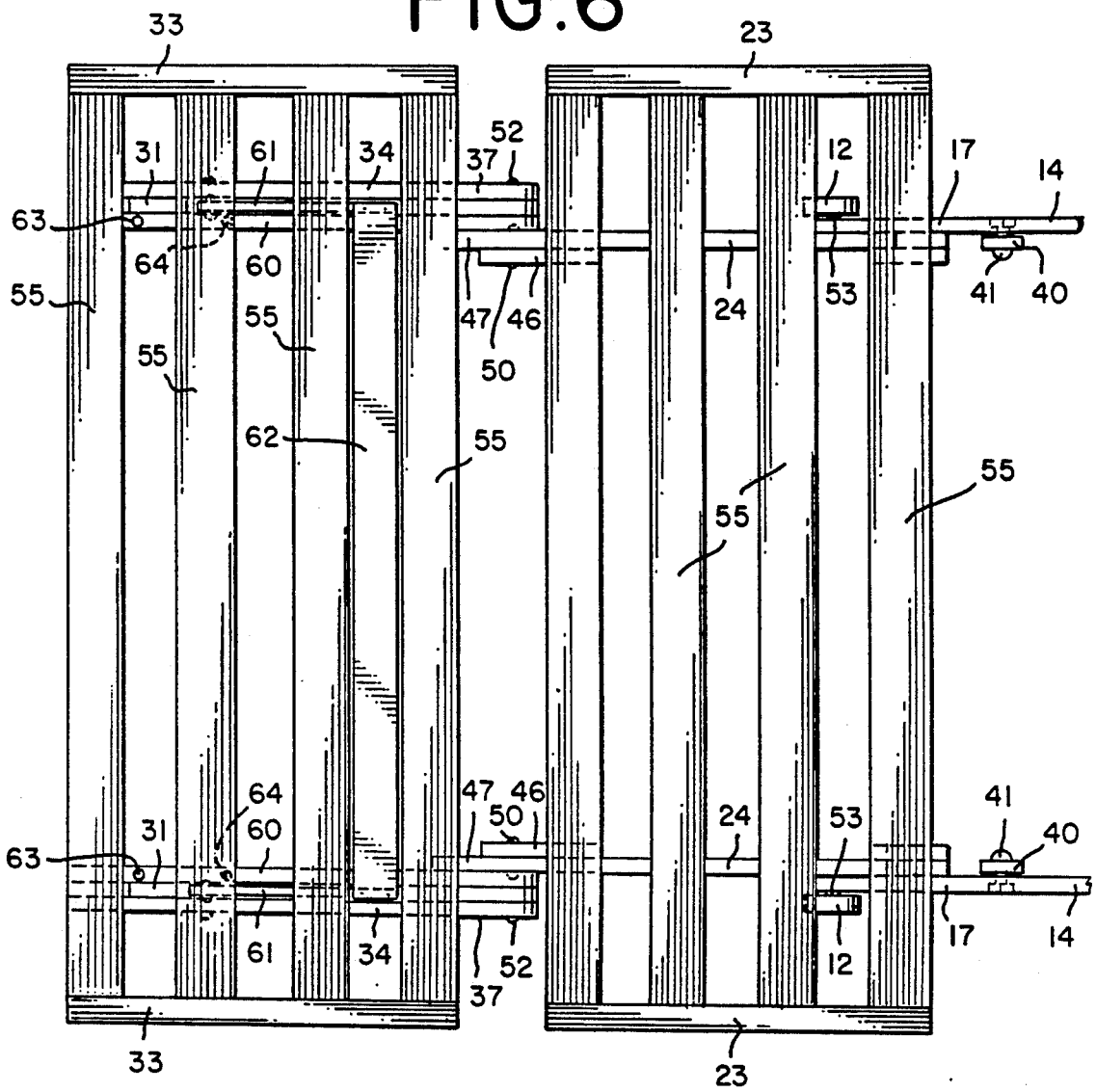
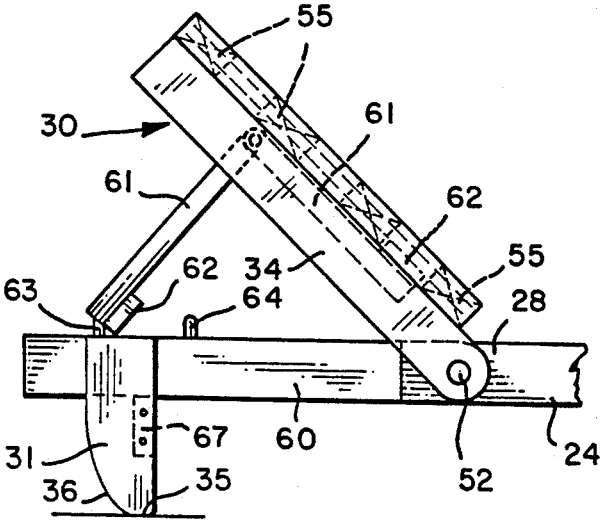
FIG.7

THREE FRAME CONVERTIBLE FUTON SOFA BED

BACKGROUND OF THE INVENTION

The present invention is a three frame sofa bed recliner, an improvement of U.S. Pat. No. 4,642,823. and U.S. Pat. No. 4,829,611 and includes a chaise lounge feature.

The present invention is a unique combination of many elements including some known in the art to provide a inexpensive to produce, easy to use, space saving, sturdy light weight, three frame sofa bed recliner made of wood with an improved structure and ease of conversion and reconversion advancing the the prior art.

The particular sofa bed recliner of the present invention is primarily of wood and can be placed against a wall. The converting from sofa bed to a recliner moves the back frame and end frame forward and downward from the recliner position to horizontal position. In so doing, the linked end frame, back frame and seat frame move forward allowing the sofa bed recliner to be fully opened without having to move the sofa bed recliner backwards from its fixed position, particularly when it is against the wall. The entire structure has the advantage of being able to interact to transform from recliner to sofa bed.

A panel on the end frame is available to be raised and supported to convert the bed configuration to a chaise lounge.

The end frame, seat frame and back frame are pivotally linked free of any main frame and each include fixed support legs and retractable legs to support a sofa bed position.

The retractable legs provide support between the end frame and back frame and prevent jackknifing.

A simple system is provided for converting and reconverting the wooden sofa bed recliner from one position to another, interlocking the seat frame and back frame for simultaneous movement from sofa bed to recliner and a pulling forward for reconverting to a sofa bed. It is desirable to be able to lift the seat frame from the horizontal position, engage it with the back frame and then easily swing the interengaged frames, including the end frame, into the recliner position without any difficulty.

In a preferred embodiment of the present invention, the length and width of the end frame, back frame and the seat frame are such that, when opened into sofa bed position, the bed portion is like a full double bed or larger.

The present invention is particularly adapted for use with a futon. Futons have become popular, offering the advantage of convertible structure adaptable for both sitting and sleeping. The present invention acts as a support structure for a futon, having the combined advantage of being a sturdy seat and a sofa bed recliner.

The present invention has the advantage of the space saving of a futon supported on a structure, which also saves space. The futon serving as a recliner cushion and as a mattress. The simplicity of the structure is economical without sacrificing utility. As a recliner there is no separate base, as a sofa bed all the frames are properly supported.

In recliner position, the end frames support legs firmly engage the back frame so the frames are locked in use. A simple wheel system improves the conversion and reconversion process.

Prior art elements are simplified combined and improved to provide a simple to construct, inexpensive to produce, easy to use three frame sofa bed recliner.

The present invention also is an improvement over U.S. Pat. No. 4,829,611. The frame sofa bed recliner provides an inexpensive means for the seat frame and back frame to interengage to be easily convert and reconvert to a sofa bed position and to a recliner position. Lifting of the seat frame enables easy interengaging of the seat frame and back frame. Then the interengaged frames are returnable to the recliner position. In moving the interengaged seat frame and back frame to resume the recliner position, the interengagement is released as the seat frame is moved backward. The reconverting is substantially easy facilitatable with wheels, with the end frame interfolding with the back frame.

The engaging means employed in the present invention to interengage the seat frame and back frame is similar to the detent disclosed in U.S. Pat. No. 4,829,611. The legs of the end frame and seat frame interlock with the back frame. The lockably engaged as a unit, lock by the weight of the person or persons seated. In moving the interlocked seat frame and back frame to resume the reclining position, the interlock also is released once the sofa bed recliner is in recliner position.

Wheels on the back frame support legs and on the seat frame extension facilitate the conversion and reconversion.

DESCRIPTION OF THE PRIOR ART

Annexed hereto is Form PTO-1449 and copies of the patents cited therein.

The prior art is replete with complex two and three piece structures for sofa beds mounted on frames where the seat and back rest may be laid flat for use as a bed. Exemplary of such structures are U.S. Pat. No. 2,796,987 and U.S. Pat. No. 1,982,930, where complex structures convert the back rest of the seat of a sofa bed from the seat or recliner to a usable bed.

A relatively simple structure, as disclosed in U.S. Pat. No. 715,114 still requires an awkward pushing to have the seat frame and back resume their prior position and does not have the engaging means of the present invention.

U.S. Pat. No. 4,642,823 discloses a sofa bed recliner where the mounted seat frame and back frame have a complex tether spring and detent mechanism, which enables a seat frame and back frame interlock. The seat frame and back frame also have an interlock when in the horizontal position, so that there is no likelihood of jackknifing.

U.S. Pat. No. 4,875,244 discloses another interlock system for reconverting a main frame wooden sofa bed recliner including a bell like detent.

U.S. Pat. No. 4,696,069 discloses a complicated metal three section sofa bed with a main frame, and an angulated rail for the conversion and reconversion from sofa to bed.

U.S. Pat. No. 3,634,893 discloses a metal track system with a bell shaped detent for the conversion of a sofa bed with a main frame, from a seat to a bed.

U.S. Pat. No. 268,941 discloses a complex three section, foldable folding and recliner chair.

U.S. Pat. No. 927,811 discloses a three part settee bed with a foldable end section at a back section, all hinged together with a wheeled body part. The structural similarity does not suggest the leg structure for supporting the sofa bed position, nor the automation for reconversion, nor the interlocking of the end frame and back frame when in recliner position.

U.S. Pat. No. 3,002,198 discloses a conventional three section metal framed sofa bed.

U.S. Pat. No. 4,800,598 discloses a typical complex metal structure, including extendable support legs for a sofa sleeper.

U.S. Pat. No. 2,244,470 discloses a typical wheel arrangement for a convertible sleeper.

U.S. Pat. No. 4,480,344 discloses a highly extendable five section metal frame with guide wheels and an in folding a mattress.

U.S. Pat. No. 4,651,363 discloses a complex metal base on wheels for convertible furniture with a scissors linkage.

U.S. Pat. No. 4,939,802 discloses a sofa bed on a base with a hinge and wheel arrangement for extending to a sofa bed position, with a metal end frame hinged to a back frame and a linkage to swing the end frame to be above the base.

U.S. Pat. No. 302,919 discloses a foldable embalming table with pivotable extending support legs engaged for retraction through slot means within the sections of the table. The individual sections of the table are hinged with the hinge acting as a linear support.

U.S. Pat. No. 4,365,369 is a typical complex, three cushion convertible metal sofa bed with hinged sections on a metal base and wheeled support means.

U.S. Pat. No. 1,061,496 is a typical convertible couch bed in three sections, apparently of metal and with complex parts expanding both backwards and forwards.

U.S. Pat. No. 4,538,308 discloses a wooden convertible sofa bed, on a base, with a wheeled seat section and hinged back and end sections supported on the base when the wheeled seat section is extended.

U.S. Pat. No. 2,278,458 discloses another typical three section convertible sofa bed with hinged portions and linked pivotal supports for supporting the portion extending beyond the support base.

U.S. Pat. No. 4,829,611 provides a detent for interlocking a mounted seat frame and back frame. The patent discloses a groove for locking the seat frame and back frame against jackknifing when the wooden sofa bed recliner is in its horizontal position.

Australian Patent No. 151,742 discloses a convoluted three piece unfoldable convertible structure with extendable support legs on a wheeled base.

U.S. Pat. No. 941,186 discloses a wheeled three section convertible chair couch with an end section pivoted on a base and resting against a back section with wheeled leg supports.

U.S. Pat. No. 2,034,985 discloses a complex convertible bed and chair in three sections against a support base with wheeled supports and retractable and extendable wheeled supports.

A BRIEF SUMMARY OF THE INVENTION

According to the present invention, a simple convertible wooden sofa bed has an end frame, seat frame and back frame. The frames are are pivotally linked at their extension portions for the converting and reconverting from sofa bed to recliner. There are fixed support legs at the front of the seat frame and back frame and at the rear of the end frame. A pivotable mounted retractable, support leg is linked between the back frame and end frame to prevent jackknifing. In the recliner position, the end frame and the back frame are upfoldable against each other, with the pivotable mounted support infolded between them and the fixed support of the end frame engaged on the extension of the seat frame.

The seat frame extension at its side portion preferably includes a wheel at its end. The extension extends beyond its pivot point a distance sufficient for the wheel to roll on the floor when the seat frame is lifted and the engaging means engaged. The back frame's fixed support also preferably has a wheel. The wheel facilitates the easy movement during the conversion process to a recliner position as the seat frame is moved downward and backward. The end frame's fixed support is preferably cambered to act as a camming surface for the end frame to be rotated to rest on the rear extension of the seat frames' side extension when the sofa bed recliner is in the recliner position. In use the weight of the users insures a locking engagement rigidifying the recliner position. In reconverting to horizontal position the seat frame is slightly lifted, and pulled forward, rolling on its wheels. The end frame cams on its fixed support and the pivotable support is lowered to the floor to stably support the end frame and back frame.

According to the present invention, a three frame sofa bed recliner has an end frame, seat frame and back frame. Each frame has a front portion, rear portion and side portions. The end frame's side portions have an extension at its front portion, the back frame's side portions have extensions from the rear portion and front portions and the seat frame's side portions have an extension from the rear portion. The end frame, back frame and seat frame extensions overlap, pivotably joined at the respective overlaps. The end frame has a fixed support protruding from a position near the rear portion near each said side portion. The back frame and seat frame have fixed supports protruding from a position near each of the side portions and near their respective front portions. The end frame and back frame have a pivotable support interfitable between the end frame and the back frame. There is an engaging means to interlock the seat frame on the back frame. The engaging means is freely movable to override the the back frame's extension portion when the seat frame is pivoted upward when the back frame is in a sofa bed position and is further engagable with the back frame extension portion when the seat frame is moved downward. The interlock is releasable when the back frame is moved to a substantially vertical position toward the end frame. The end frame's fixed support is engagable with the seat frame's extension portions when the end frame is in recliner position.

The end frame's fixed support may have a camber which may be interactable to engage the end frame's fixed support at the seat frame's extension. The a detent may interlock to interlock the seat frame and back frame. The back frame's front portion extension may have a horizontal edge and a vertical edge and the detent may engage the back frame's extension along the horizontal edge and along the vertical edge. The detent may have a notch or horizontal engaging and vertical engaging portions.

The seat frame's extension may have a length sufficient to engage a floor surface beneath the sofa bed recliner when the detent is engaged with the back frame front portion extension and the seat frame's extension may have a wheel. The back frame's fixed support may have a wheel, the back frame's fixed support may have a wheel.

The pivotable support may have a first support pivotably mounted on the back frame, a second support pivotably mounted on the end frame, and first and second supports pivotably interlockable to extend and engage a floor surface beneath the sofa bed recliner when the sofa bed recliner is in a sofa bed position. The end frame, seat frame and back frame each may have a cross beam, joining like portions of each the frames and the cross beams may join the fixed support of each the frames.

The end frame may have a frame portion and support portion, with side portions each having an extension from the front and overlapping the back frame's extension and pivotably joined at the overlap. The end frame's fixed supports protruding from the support portion. The frame portion is separately pivotable from the support portion at the overlap, and there are means to space apart the frame portion and the support portion when the sofa bed recliner is in a sofa bed position. The means to space away the frame portion and the support portion may have at least one arm pivotably mounted between the frame portion and the support portion and engagable to support the frame portion spaced away from the support portion. The means to space away the frame portion and the support portion may be a pair of arms, pivotably mounted between the frame portion and the support portion and engagable to support the frame portion, spaced away from the support portion. The means to space away the frame portion and the support portion may be a pair of arms pivotably mounted on the frame portion and engagable to support the frame portion. The pair of arms may have a cross beam. The support portion may have means to stop an arm, which may be pegs.

Although such novel feature or features believed to be characteristic of the invention are pointed out in the claims, the invention and the manner in which it may be carried out may be further understood by reference to the description following and the accompanying drawings.

BRIEF DESCRIPTION OF THE DRAWING

FIG. 6 is a top plan detail of a chaise lounge feature in the end frame.

FIG. 7 is a detail side elevation of FIG. 6, showing the chaise lounge panel in elevated engagement.

Referring now to the figures in greater detail, where like reference number denote like parts in the various figures.

DETAILED DESCRIPTION

The description of the figures includes description of one side of the sofa bed recliner 1, it being understood that the parts are symmetrically distributed and identical throughout the sofa bed recliner 1, with the exception of the functioning features of the chaise lounge configuration.

Figure 1:
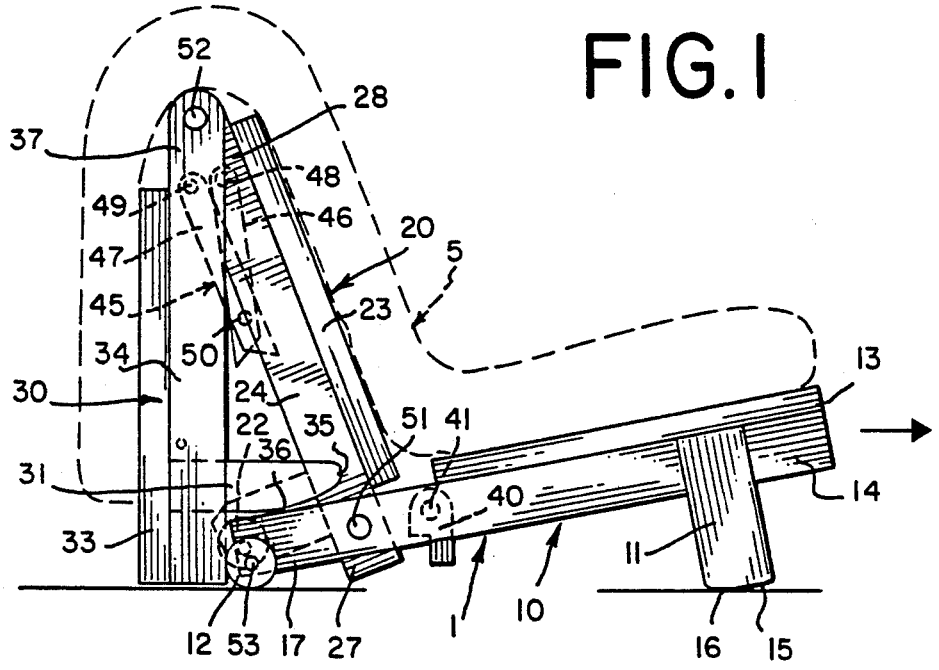
FIG. 1 is a side elevation of the sofa bed recliner in recliner position.

The sofa bed recliner 1, as shown in the figures, is primarily concerned with use with a futon 5, as shown dotted in in FIG. 1.

As shown in FIG. 1, the sofa bed recliner 1 is shown in recliner position. There is a seat frame 10, a back frame 20 and an end frame 30. The seat frame 10 has support legs 11. There is an end rail 13 of the seat frame 10. The seat frame 10 includes a support rail 14.

The support leg 11, preferably has a bottom surface 15 and a second bottom surface 16. The support rail 14 has an extension portion 17 extending backwards beyond the end rail 13. At the end of the extension portion 17 there is a wheel 12.

Figure 2:
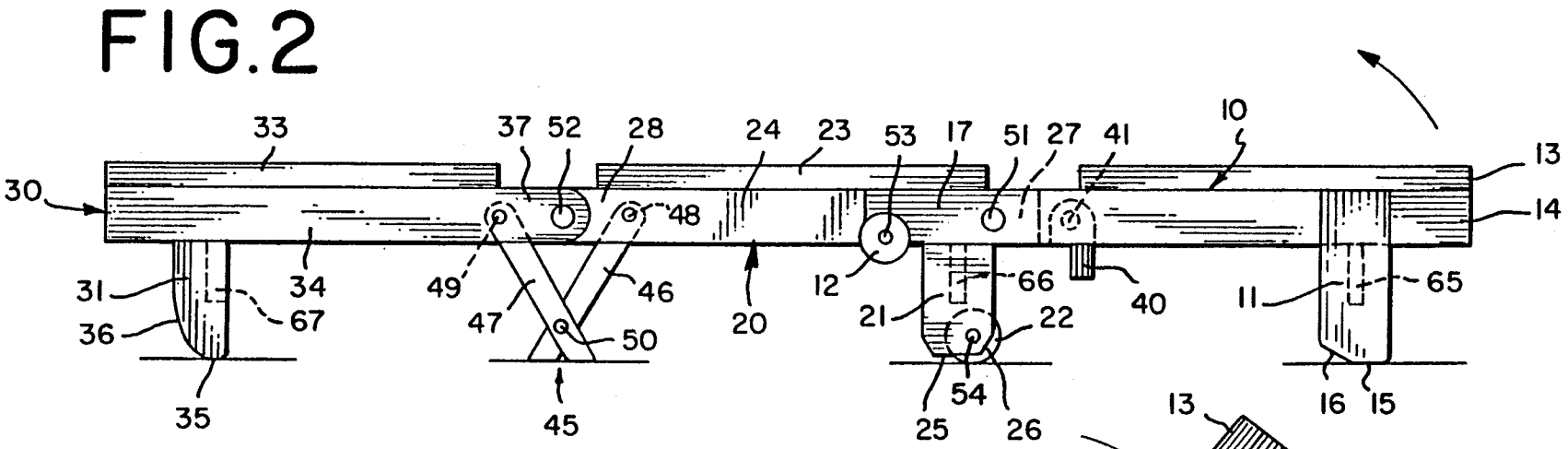
FIG. 2 is a side elevation of the sofa bed recliner of FIG. 1, in sofa bed position.
Figure 3:
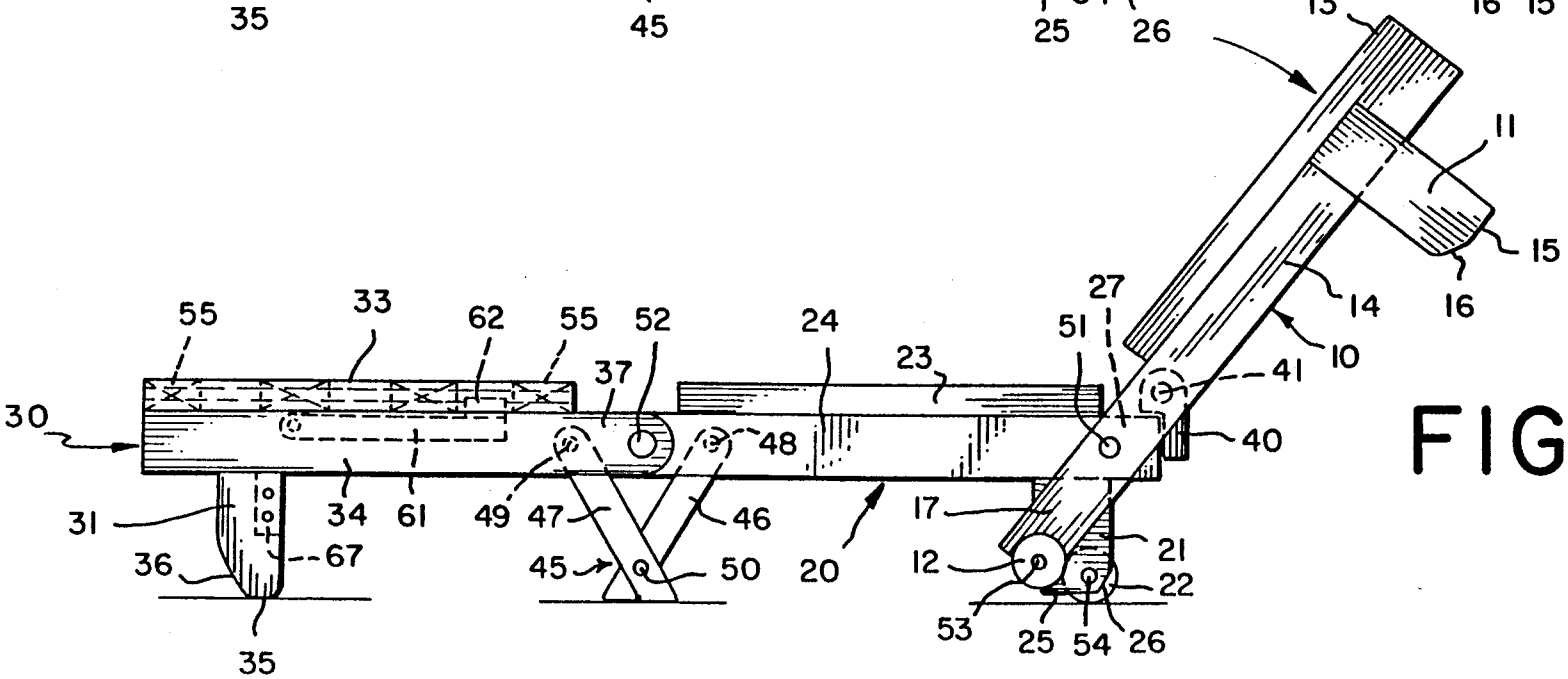
FIG. 3 is a side elevation of the sofa bed recliner of FIG. 1, with the seat frame engaged for reconversion to a recliner position.
Figure 5:
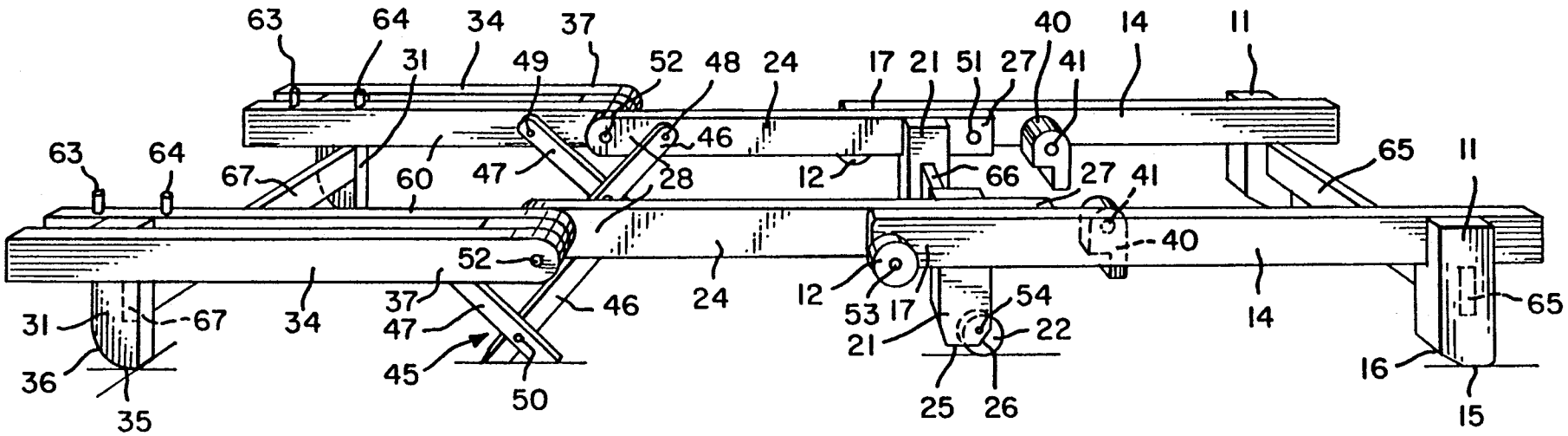
FIG. 5 is an isometric detail view of of the understructure of the frames of the present invention.

The back frame 20 has a support leg 21, which, as can be best seen in FIGS. 2, 3 and 5, includes a wheel 22. There is an end rail 23 and a support rail 24. The support leg 21 has a bottom first surface 25 and a second second surface 26. The support rail 24 has a first extension 27 and a second extension 28. The end frame 30 has a support leg 31, an end rail 33 and a support rail 34. The support leg 31 has a bottom surface 35 and a camber 36. The support rail 34 has a forward extending extension 37. As can best be seen in FIG. 5, the support rail 14 has a detent 40 on the extension 17, which is movable on a pivot 41.

As can best be seen in FIGS. 2, 3, 4 and 5, there is a pivotable support 45 between the rear portion of the back frame 20 and at the front portion of the end frame 30. The pivotable support 45 has a first leg 46, a second leg 47, a first leg pivot 48, a second leg pivot 49 and a pivot 50, joining first and second legs 46 and 47.

The seat frame 10 and back frame 20 are joined at the pivot 51, which passes through the rearward extension portion 17 of the support rail 14 and through the forward extending extension 27 of the back frame 20. The back frame 20 has a second extension 28 extending rearward, with a pivot 52 engaging the forward extending extension 37 of the end frame 30.

As shown in FIG. 7, the end frame 30 has a second support rail 60, which is also separably pivotable on a pivot 52, upon which the back frame 20 second extension 28 and forward extending end frame 20 extension 37 pivots.

The wheel 12 of the seat frame 10 is rotatably mounted on a pin 53.

As can best be seen in FIG. 2, the wheel 22 is mounted on a pin 54 through the support leg 21.

As can be seen in FIG. 6, the end rails 33 of the end frame 30, are joined by slats 55, not shown in detail. The end rails 13 and 23 of the seat frame 10, back frame 20 are also joined by slats 55.

The slats 55 are affixed to the respective support rails 14, 24 and 34 by screw means or glue means, well known in the art, but not specifically shown.

The slats 55 on the end frame 30 are affixed to the support rail 34. As shown in FIG. 7, there is a second support rail 60. As shown in FIGS. 6 and 7, support arms 61 are pivotally mounted on support rails 34. The support arms 61 are joined by a cross member 62. As shown in FIG. 7, the cross member 62 and support arms 61 can be swung backwards and engaged against a first peg 63 in the second support rail 60, elevating the end frame 30 to act as a back rest for a chaise lounge. The elevation may be adjusted by use of second peg 64, or other pegs (not shown), to select an elevation for the end frame 30. Extension 37 of the support rail 34 and the support rail 60 both pivot on the pivot 52.

As shown in FIG. 5, it can be seen that the support legs 11 are joined by a cross beam 65. The support legs 21 are joined by a cross beam 66 and the legs 31 are joined by a cross beam 67.

OPERATION

In operation, the sofa bed recliner 1, as shown in FIG. 1, is in recliner position. At one end, the support rail 34 rests on the floor with the support leg 31 engaged over the support rail 14.

The extension 17 passes beyond the pivot 51 and abuts the support rail 34 with the wheel 12 generally touching the floor, as well as the support rail 34. The back frame 20 slopes slightly forward from the vertical end frame 30 and serves as a recliner back rest. The seat frame 10 is supported off the floor, sloping upward from the wheel 12 to the support leg 11. The second surface 16 of the leg 11 rests on the floor.

In this configuration of the sofa bed recliner 1, no main frame is required.

In converting to a sofa bed position, the seat frame 10 is lifted slightly and pulled forward. The pulling forward is enabled by the rolling of the wheel 12.

The forward movement of the seat frame 10, rolling on the wheel 12, disengages the support leg 31 of the end frame 30 from the support rail 14. The end frame 30 pivots down and forward.

As can be seen in FIG. 2, the camber 36 of the support leg 31 easily allows the disengagement of the support leg 31 and support rail 14. The end frame 30 pivots over the support leg 31, as it touches the floor, and the end frame 30 is placed in sofa bed position. As the seat frame 10 is being pulled forward, the wheel 22 of the back frame 20 engages the floor, and enables the back frame 20 to be pulled into sofa bed position.

As the end frame 30 and back frame 20 spread apart, the pivotal support 45 with its first leg 46 and second leg 47, is extended, providing support between the end frame 30 and back frame 20 against jackknifing when the sofa bed position is in use.

In the sofa bed position, the futon 5 is atop the seat frame 10, back frame 20 and end frame 30.

Figure 4:
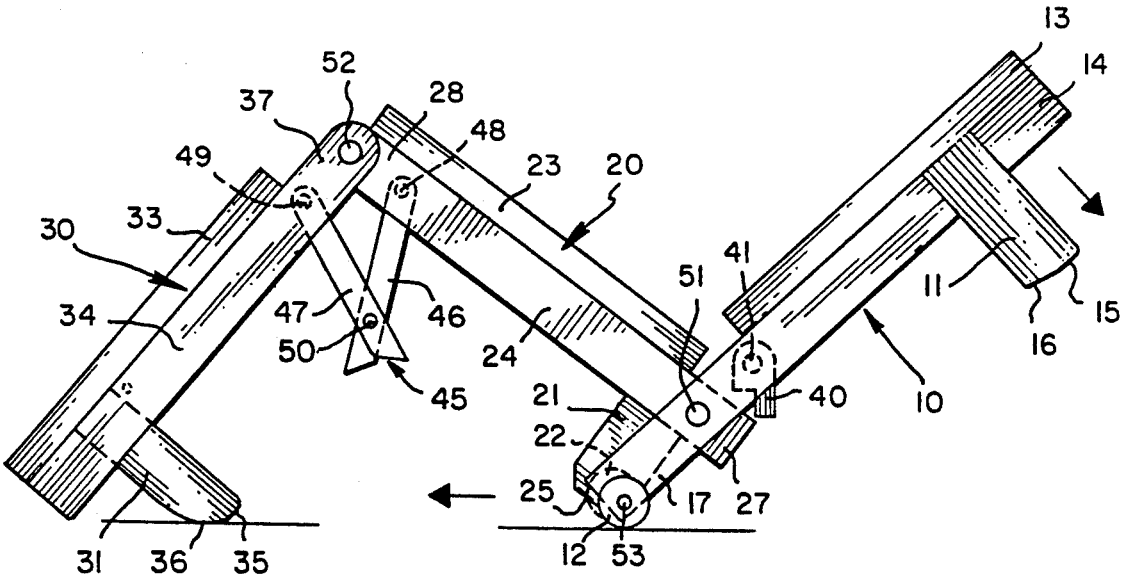
FIG. 4 is a side elevation of FIG. 3 showing the release of the seat frame engaging means in the reconverting to recliner position.

In the reconversion process, the seat frame 10 is pivoted upward so that the detent 40 can override the first extension 27 of the back frame 20, and the pivot 40 engaged. As can be seen in FIG. 3, when this happens, the wheel 12 is also touching the floor. Then, pushing the seat frame 10 down and forward, lifts the back frame 20 so that the wheel 22 rolls along the floor. The backward pushing elevates the rear portion of the back frame 20 and the front portion of the end frame 30, pivoting the support rail 24 downward and away from the detent 40, as can be seen in FIG. 4. The pivotable support 45 is then retracted and collapsed between the back frame 20 and end frame 30. The end frame 30 is pivoted onto its rear portion with the support leg 31 protruding and its camber 36 ramping onto the extension 17 of the support rail 13. As can be seen in FIG. 5, the support rails 14, 24 and 34 are shown, supported and held apart by their respective cross beams 65, 66 and 67. The seat frame 10, back frame 20 and end frame 30 are provided with end rails 13, 23 and 33, between which run slats 55, to serve as a webbing for the seat frame 10, back frame 20 and end frame 30.

The end frame 30, when provided with a second support rail 60, may be separately tilted forward, as shown in FIG. 7, by swinging down the support arms 61, joined by their cross member 65 and engaging them optionally with the pins 63 or 64, to convert the sofa bed position of the sofa bed recliner 1 to that of a chaise lounge. The support arms 61 nestle between the support rail 34 and support rail 60. The cross beam 62, not extended, nestles between the slats 55.

The terms and expressions which are employed are used as terms of description; it is recognized, though, that various modifications are possible.

It is also understood the following claims are intended to cover all of the generic and specific features of the invention herein described; and all statements of the scope of the invention which as a matter of language, might fall therebetween.

Having described certain forms of the invention in some detail, what is claimed is:

1. A three frame sofa bed recliner having a sofa bed position and a recliner position comprising end frame means; seat frame means; and back frame means, each said frame means having a front portion and a rear portion and side portions, said end frame means' side portions including an extension from said front portion, said back frame means' side portions including an extension from said rear portion and front portion, said seat frame means' side portions including an extension from said rear portion, said end frame means and back frame means and seat frame means' extensions overlapping, said end frame means and back frame means and seat frame means pivotably joined at said respective overlaps, said end frame means including at least two fixed support means, said fixed support means protruding from positions near said rear portion and near each said side portion, said back frame means and seat frame means including at least two fixed support means; at least one said fixed support means protruding from a position near each said side portion and near said respective front portions, said end frame means and back frame means including pivotable support means therebetween, said pivotable support means interfitable between said end frame means and said back frame means, engaging means to interlock said seat frame means and said back frame means, said engaging means on said seat frame means, said engaging means freely movable to override said back frame means' extension portion when said seat frame means is pivoted upward when said back frame means is in a sofa bed position, said engaging means further engagable with said back frame means extension portion when said seat frame means is moved downward interlocking said seat frame means and back frame means, said interlock releasable when said back frame means is moved to a substantially vertical position toward said end frame means, and said end frame's fixed support means engagable with said seat frame means' extension portions when said end frame means is in recliner position.

2. The invention of claim 1 wherein said end frame means' fixed support means include a camber.

3. The invention of claim 2 wherein said camber is interactable to engage said end frame means' fixed support means at said seat frame means' extension.

4. The invention of claim 1 wherein said engaging means to interlock said seat frame means and said back frame means is a detent.

5. The invention of claim 4 wherein said back frames' front portion extension includes a horizontal edge and a vertical edge and said detent includes means to engage said back frame means' extension along said horizontal edge and along said vertical edge.

6. The invention of claim 5 wherein said detents' means to engage said back frame means' front portion extension along said horizontal edge and along said vertical edge is a notch.

7. The invention of claim 4 wherein said detent includes a horizontal engaging portion and a vertical engaging portion.

8. The invention of claim 1 wherein said seat frame means' extension has a length sufficient to engage a floor surface beneath said sofa bed recliner when said engaging means is engaged with said back frame means front portion extension.

9. The invention of claim 8 wherein said seat frame means' extension includes a wheel.

10. The invention of claim 1 wherein said back frame means' fixed support means includes a wheel.

11. The invention of claim 9 wherein said back frame means' fixed support means includes a wheel.

12. The invention of claim 1 wherein said pivotable support means comprises a first support pivotably mounted on said back frame means, a second support pivotably mounted on said end frame means, said first and second supports pivotably interlocked to extend and engage a floor surface beneath said sofa bed recliner when said sofa bed recliner is in a sofa bed position.

13. The invention of claim 1 wherein said end frame means and seat frame means and back frame means each include a cross beam means, said cross beam means joining like portions of each said frames.

14. The invention of claim 13 wherein said cross beam means join said fixed support means of each said frame.

15. The invention of claim 1 wherein said end frame means includes a frame portion and support portion, each said portion having side portions, each said side portion having an extension from said front portion overlapping said back frame means extension and pivotably joined at said overlap, said end frame means' fixed support means protruding from said support portion, said frame portion separately pivotable from said support portion at said overlap, and means to space away said frame portion and said support portion when said sofa bed recliner is in a sofa bed position.

16. The invention of claim 15 wherein said means to space away said frame portion and said support portion includes at least one arm pivotably mounted between said frame portion and said support portion and engagable to support said frame portion spaced away from said support portion.

17. The invention of claim 16 wherein said means to space away said frame portion and said support portion comprises a pair of arms pivotably mounted between said frame portion and said support portion and engagable to support said frame portion spaced away from said support portion.

18. The invention of claim 16 wherein said means to space away said frame portion and said support portion comprises a pair of arms pivotably mounted on said frame portion and engagable to support said frame portion spaced away from said support portion.

19. The invention of claim 18 wherein said pair of arms include a cross beam therebetween.

20. The invention of claim 15 wherein said means to space away said frame portion and said support portion includes at least one stop means mounted on said support portion to engage said at least one arm.

21. The invention of claim 20 wherein said stop means is at least one peg.

* * * * *